US006639161B2

(12) United States Patent
Meagher et al.

(10) Patent No.: US 6,639,161 B2
(45) **Date of Patent: *Oct. 28, 2003**

(54) DOOR UNLATCH SWITCH ASSEMBLY

(75) Inventors: James Patrick Meagher, Indianapolis, IN (US); Vaughn Clark Arens, Greenwood, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/262,496

(22) Filed: Oct. 1, 2002

(65) Prior Publication Data

US 2003/0029704 A1 Feb. 13, 2003

Related U.S. Application Data

(63) Continuation of application No. 09/753,829, filed on Jan. 3, 2001, now Pat. No. 6,465,752.

(51) Int. Cl.[7] ..... H01H 13/00

(52) U.S. Cl. ..... 200/61.73; 200/511; 200/512; 200/341; 200/520

(58) Field of Search ..... 70/278; 200/17 R, 200/511, 512, 61.58 R, 520, 341, 61.41–61.44, 61.23, 85 R; 292/201; 307/9.1, 10 R, 10.1; 340/5.2, 5.51; 361/71

(56) References Cited

U.S. PATENT DOCUMENTS

| | | | | |
|---|---|---|---|---|
| 4,342,210 A | | 8/1982 | Denningham | 200/5 E |
| 4,496,803 A | | 1/1985 | Smith | 200/5 A |
| 4,624,491 A | | 11/1986 | Vincent | 292/201 |
| 4,762,348 A | | 8/1988 | Matsumoto | 292/201 |
| 5,654,687 A | | 8/1997 | LaBonde | 340/426 |
| 5,717,429 A | | 2/1998 | Coulon et al. | 345/168 |
| 5,775,142 A | | 7/1998 | Kim | 70/277 |
| 5,821,482 A | | 10/1998 | Ootani et al. | 200/5 A |
| 5,967,297 A | | 10/1999 | Kaufman et al. | 200/241 |
| 6,075,294 A | | 6/2000 | Van den Boom et al. | 307/10.1 |
| 6,191,682 B1 | | 2/2001 | Wolfgang | 340/5.2 |
| 6,465,752 B2 | * | 10/2002 | Meagher et al. | 200/61.73 |

* cited by examiner

*Primary Examiner*—Michael Friedhofer
(74) *Attorney, Agent, or Firm*—Harness, Dickey & Pierce, P.L.C.

(57) ABSTRACT

A switching apparatus and electromechanical latching system includes an elastomeric button with independently movable electrically conducting spring plates mounted to the button. The button includes a button cap including a relatively high durometer material and button walls including a relatively low durometer button material, such that the button walls collapse and the button cap generally maintains its shape when pressure is applied to the button cap. Each spring plate includes a plurality of cantilever springs. When the button is depressed, the cantilever springs of the spring plates come in contact with electrical tracks to complete a circuit. The completion of the circuit causes a signal to be sent to a vehicle computer, which signals a motor to release the automotive vehicle door latch.

11 Claims, 4 Drawing Sheets

DOOR UNLATCH SWITCH ASSEMBLY

CROSS-REFERENCE TO RELATED APPLICATIONS

This application is a continuation of U.S. patent application Ser. No. 09/753,829 filed on Jan. 3, 2001 now U.S. Pat. No. 6,465,752. The disclosure of the above application is incorporated herein by reference.

FIELD OF THE INVENTION

The present invention relates generally to automotive vehicle door latches and more particularly to an electromechanical door latch for an automotive vehicle.

DISCUSSION

Traditionally, mechanical means have been used to unlatch automotive vehicle doors. It is possible, however, to reduce the effort necessary to unlatch an automotive vehicle door by employing an electromechanical means. A signal from a switch, such as a button on the exterior of the car door, can trigger the electromechanical release of the door latch.

In order to electromechanically trigger the latch release, a switch must be able to short two electrical inputs to ground when depressed. And to satisfy styling and ergonomic requirements, the switch is preferably actuated by a low profile button of adequate size. Current technology uses conductive pills insert molded within the interior of the top of the button to selectively complete a circuit. When the button is pressed downward, the conductive pills contact electrical tracks on the base supporting the button, thus shorting the two inputs to ground. The conductive pills also serve as stops, preventing the button from being further depressed. A problem inherent with this technology is that the pills do not function independently of one another, and thus it is possible to depress the button fully and have only one of the pills make contact with the electrical tracks. For example, because of the button size necessary to fulfill ergonomic requirements, it is common for the button to rock or teeter when an off-center actuation force is applied, thus forcing only one of the pills into contact with the electrical tracks. Because of the unreliable connection inherent in the conductive pill design, it is often necessary to use expensive conducting materials for the pills to ensure better connections, driving the cost of the switch higher. Therefore, it is desirable to have a button that allows both inputs to be shorted to ground when the button is pressed regardless of rocking or teetering, thereby providing a more reliable switching apparatus at a lower cost.

SUMMARY OF THE INVENTION

The switching apparatus of the present invention includes an elastomeric button with independently movable electrically conducting spring plates mounted to the button. Each spring plate includes a plurality of cantilever springs. When the button is depressed, the cantilever springs of the spring plates come in contact with electrical tracks, completing a circuit. The completion of the circuit causes a signal to be sent to a vehicle computer, which instructs a motor to release an automotive vehicle door latch.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
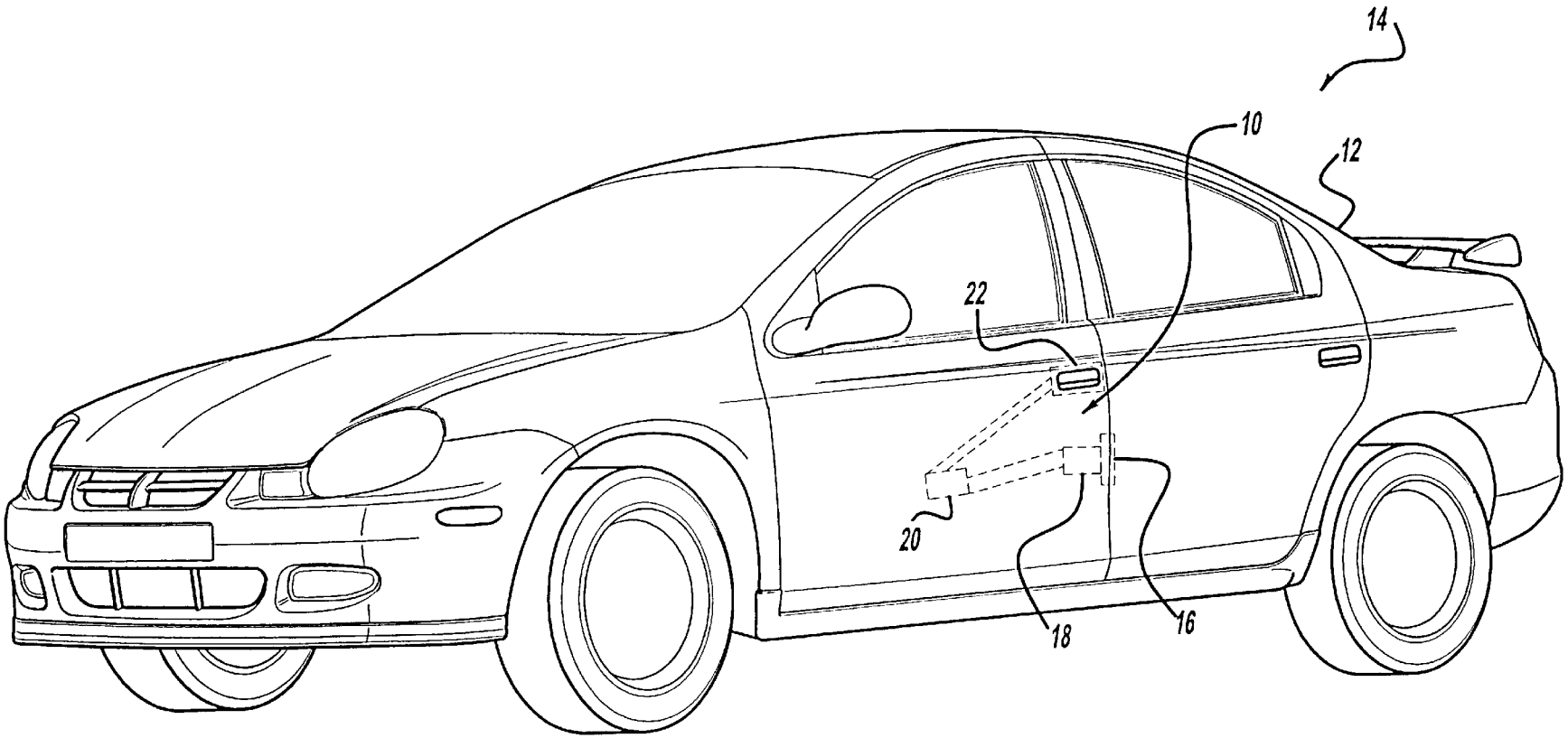
FIG. 1 is a perspective view of an automotive vehicle including a schematic of an electromechanical door-latching assembly in accordance with a preferred embodiment of the present invention.

With reference to FIG. 1 of the drawings, there is shown an automotive vehicle door 10 attached to the body 12 of an automobile 14 and movable between an open and a closed position. In a preferred embodiment of the present invention, the door 10 is held fixed in the closed position by an electromechanical door latch 16. A motor 18 is actuable to release the door latch 16. A vehicle computer 20 preferably controls the motor 18, instructing it when to release the door latch 16. The computer 20 is electrically coupled to a switch within a switching assembly 22, the actuation of which generates an electrical signal. The electrical signal is propagated to the computer 20, which controls the electromechanical release of the door latch 16. Thus, to open the vehicle door 10, a user actuates the switch within the switching assembly 22 to initiate the release of the door latch 16.

Figure 2:
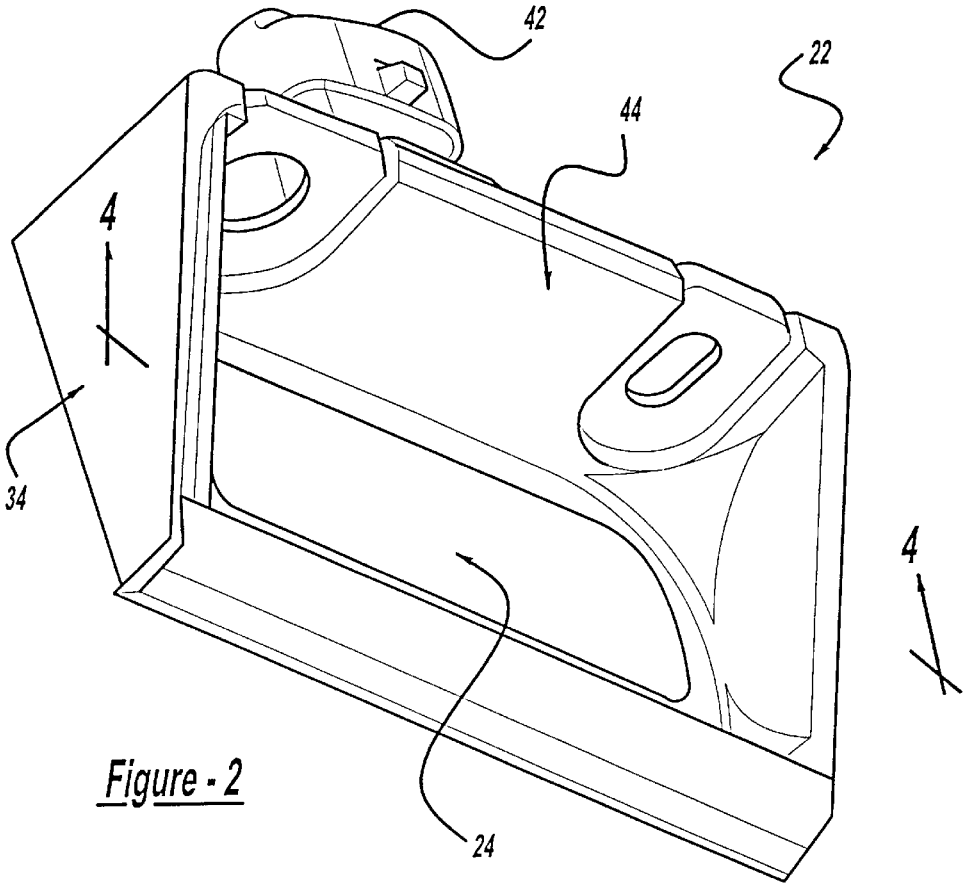
FIG. 2 is a perspective view of a switch assembly in accordance with a preferred embodiment of the present invention.
Figure 3:
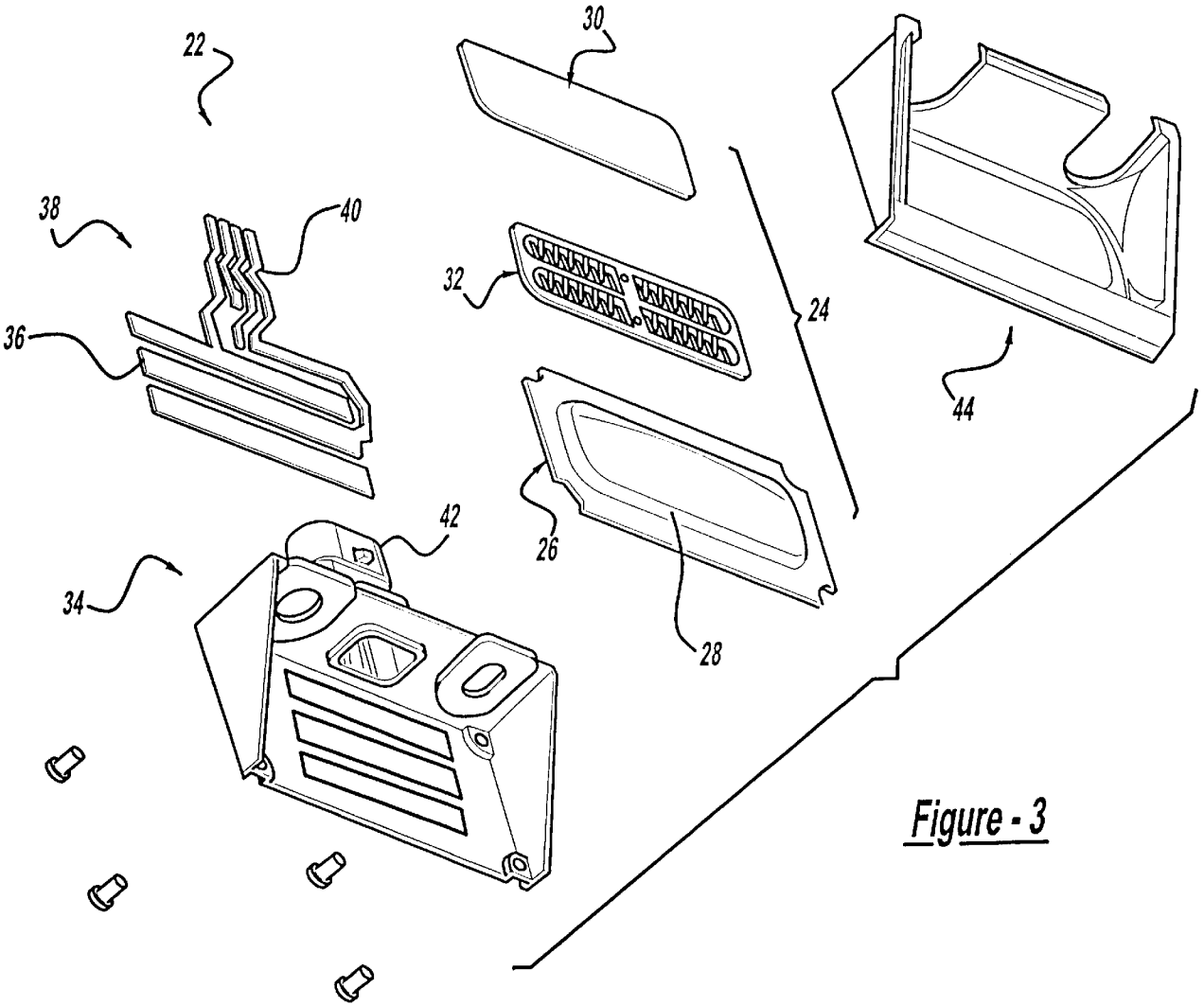
FIG. 3 is an exploded view of the switch assembly of FIG. 2.

With reference to FIGS. 2 and 3 of the drawings, in a preferred embodiment of the present invention, the switch includes a button 24 housed within the switching assembly 22. The button 24 is mounted to a switching assembly base 34 and includes a button frame 26 and a button cap 30. The frame 26 includes an upright wall 28 surrounding an aperture, which is covered by the button cap 30 when assembled. Within the button 24, mounted to the button cap 30, is a set of spring plates 32. Electrical tracks 36 of a leadframe 38 are also mounted, preferably insert molded, to the switching assembly base 34. The leads 40 of the leadframe 38 are fed out of the switching assembly base 34 through a connector 42, which is preferably a thermoplastic rig that is sealed to protect the electrical contact area. A switching assembly cover 44 fits over the button 24 and is fastened to the switching assembly base 34, preferably by using screws 46, thus sealing the button 24 within the switching assembly 22. One skilled in the art will recognize that any of a variety of methods can be used to secure the switching assembly cover 44 to the switching assembly base 34 and are therefore within the scope of the present invention.

Figure 4:
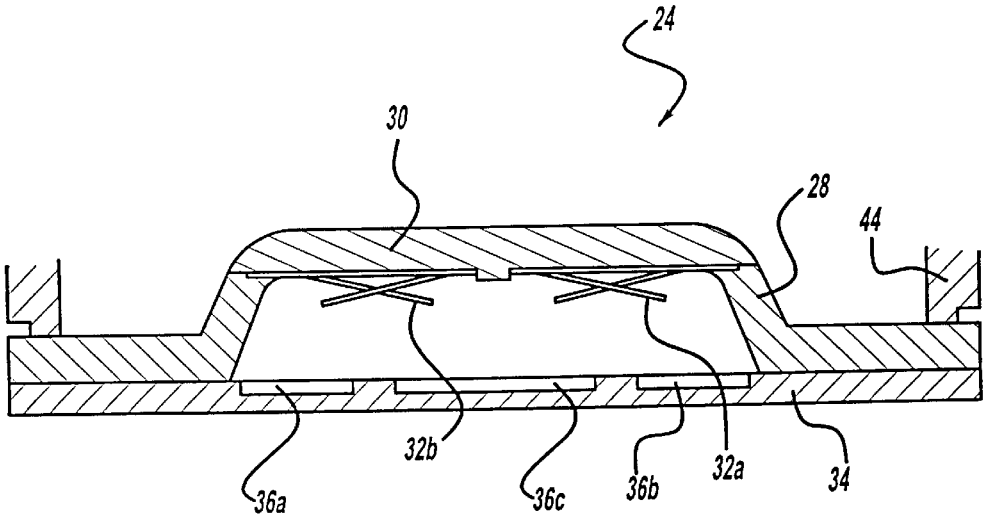
FIG. 4 is a sectional side view of a button along line 4—4 of FIG. 2.
Figure 5:
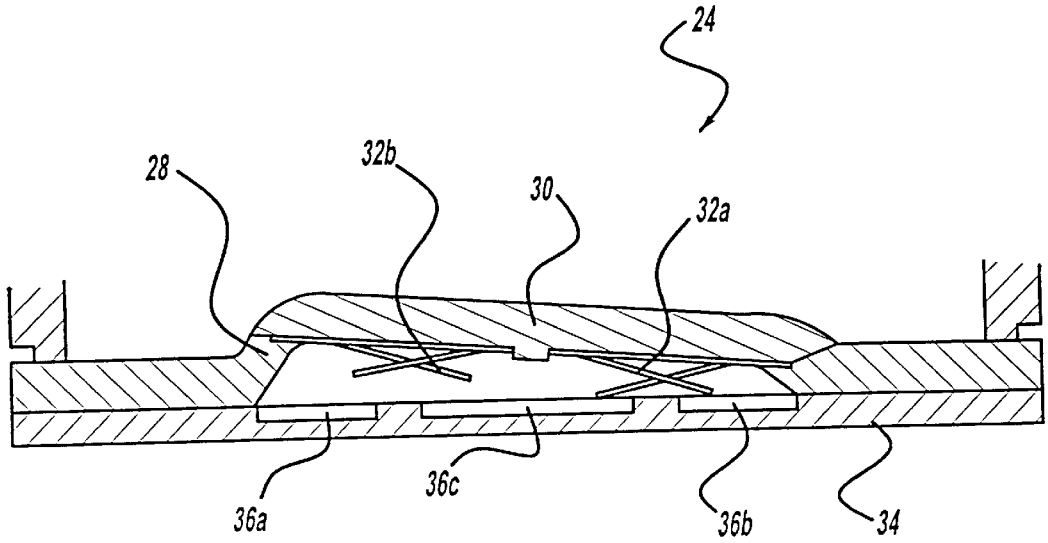
FIG. 5 is a sectional side view of the button of FIG. 4 in an off-set depressed position.

The button 24 is preferably constructed of at least two different materials. Preferably, the button frame 26 is made from a relatively low durometer material and the button cap 30 is made from a relatively high durometer material. The button frame 26, and particularly the wall 28 of frame 26, is preferably made from a relatively low durometer (50 or 60 shore durometer) rubber material and the button cap 30 is preferably made from a relatively high durometer (about 80 shore durometer) rubber material or a rigid thermoplastic. As a result, when pressure is applied to the button 24 at the button cap 30, the button cap 30 retains its shape while the walls 28 of the button 24 deform, as shown in FIGS. 4 and 5.

In order for the signal to be propagated to the computer 20, it is necessary to short two separate inputs to a common ground. With further reference to FIGS. 4 and 5, this is preferably achieved by electrically connecting two input electrical tracks 36*a* and 36*b* to a common ground electrical track 36*c* using the spring plates 32, which are made of a conducting material. Preferably the spring plates 32 include cantilever springs 48 attached to the ends of the spring plates 32, such that when a spring plate 32 makes contact with the electrical tracks 36, each cantilever spring 48 will contact a single electrical track 36.

In a preferred mode of operation, a user applies pressure to the center of the button cap 30, whereby the walls 28 of the button assembly 26 deform while the button cap 30 retains its shape. The deformation of the walls 28 allows the spring plates 32 to come in contact with the electrical tracks 36, completing the circuit and initiating the release of the door latch 16. In another preferred mode of operation, a user applies pressure to the button cap 30 off center such that the button cap 30 teeters or rocks. With reference to FIG. 5, because of the uneven pressure, the spring plates 32*a* contact the electrical tracks 36*b* and 36*c*, but spring plates 32*b* do not. Because the spring plates 32*a* can be compressed, it is possible, while unnecessary to complete the circuit, to continue depressing the button 24 until the spring plates 32*b* contact the electrical tracks 36*a* and 36*c*. Similarly, an off-set actuation of the button 24 causing only the spring plates 32*b* to contact the electrical tracks 36*a* and 36*c* completes the circuit. Accordingly, the release of the door latch 16 can be triggered even if the actuation force is applied to the button 24 offset from the center of the button cap 30.

The above-described control schemes have the important advantage that an automobile door can be unlatched without having to press a button directly in the center, allowing for a larger or ergonomic doorlatch. Additionally, among other advantages, the present invention can be implemented using low cost conducting materials, such as silver plating, for the spring plates 32, because the reliability of the contact is enhanced by the disclosed design.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A switching apparatus for completing a circuit to actuate a latch, wherein the actuation of the latch is initiated in response to the completion of the circuit, the apparatus comprising:

an elastomeric button;

a base supporting said button;

a leadframe supported by said base, electrically coupled to a control, and including at least one electrical contact;

an electrically conducting spring plate having a plurality of cantilever springs, said spring plate operatively disposed intermediate said button and said leadframe;

wherein the depression of said button causes said spring plate to come into contact with said at least one electrical contact to complete the circuit and initiate actuation of the latch.

2. The apparatus of claim 1, wherein said button includes walls and wherein said walls of said button collapse when said button is depressed.

3. The apparatus of claim 2, wherein said button can be further depressed even after said spring plate to comes into contact with said at least one electrical contact.

4. The apparatus of claim 1, wherein said first and second spring plates are silver plated.

5. The apparatus of claim 1, wherein said leadframe comprises a printed circuit board.

6. The apparatus of claim 1, wherein said apparatus comprises a sealed unit closed from the outside environment.

7. The apparatus of claim 1, wherein said spring plate is mounted to said button.

8. An electromechanical latching system for an automotive vehicle door including a door latch, said system comprising:

a motor mounted in the vehicle door, said motor operationally releasing a door latch to allow the vehicle door to be opened;

a vehicle computer coupled to said motor, said computer controlling the operation of said motor; and an electromechanical switch assembly coupled to said vehicle computer, wherein actuation of said switch assembly causes a signal to be sent to said vehicle computer causing said motor to release the door latch, the switch assembly including:

an elastomeric push button;

a base supporting said button;

at least two electrical tracks supported by said base; and a conducting spring plate molded to said push button, said spring plate including independently movable cantilever springs, wherein said cantilever springs are movable to contact said electrical tracks to complete a circuit.

9. The system of claim 8, wherein the push button includes a button cap and button walls, the button cap including a higher durometer material than the button walls, whereby the shape of the button cap remains relatively consistent and the button walls generally collapse when force is applied to the button cap.

10. The apparatus of claim 8, wherein said electrical contacts comprise a printed circuit board.

11. The apparatus of claim 8, wherein said switch assembly comprises a sealed unit closed from the outside environment.

* * * * *

UNITED STATES PATENT AND TRADEMARK OFFICE

CERTIFICATE OF CORRECTION

PATENT NO. : 6,639,161 B2 
DATED : October 28, 2003
INVENTOR(S) : James Patrick Meagher et al.

It is certified that error appears in the above-identified patent and that said Letters Patent is hereby corrected as shown below:

Column 4,
Line 13, after "plate" delete "to".
Lines 15-16, "first and second spring plates are" should be -- spring plate is --.
Line 24, after "electromechanical" delete "latching".
Lines 24-25, after "system" delete "for an automotive vehicle door including a door" and insert -- for operating a --.
Line 27, after "motor" delete "mounted in the vehicle door, said motor" and insert -- for --.
Line 28, after "releasing" delete "a door" and insert -- said --.
Lines 28-29, after "latch" delete "to allow the vehicle door to be opened".
Line 30, after "a" delete "vehicle".
Line 32, "an electromechanical" should be -- a --.
Line 33, before "computer" delete "vehicle".
Line 34, after "said" delete "vehicle".
Line 35, after "the" delete "door".
Line 39, "tracks" should be -- contacts --.
Line 40, "molded to" should be -- cooperative with --.
Line 43, "said electrical tracks" should be -- at least one of said electrical contacts --.
Line 46, delete "a button cap and".
Line 46-49, delete "the button cap including a higher durometer material than the button walls, whereby the shape of the button cap remains consistent".
Line 50, after "button" delete "cap".

Signed and Sealed this

Twenty-third Day of March, 2004

JON W. DUDAS
*Acting Director of the United States Patent and Trademark Office*